US005179325A

United States Patent [19]

Aragon, Jr.

[11] Patent Number: 5,179,325

[45] Date of Patent: Jan. 12, 1993

[54] TOUCH-SENSITIVE ILLUMINABLE DOOR LOCK

[76] Inventor: William G. Aragon, Jr., 3181 W. 36th Ave., Denver, Colo. 80211

[21] Appl. No.: 636,696

[22] Filed: Jan. 2, 1991

[51] Int. Cl.[5] ..... E05B 17/10; H05B 37/02

[52] U.S. Cl. ..... 315/136; 340/542; 362/100; 315/129

[58] Field of Search ..... 315/129, 362, 136; 340/542, 545, 528, 546, 547, 548, 549; 362/100

[56] References Cited

U.S. PATENT DOCUMENTS

| | | | |
|---|---|---|---|
| 2,831,959 | 4/1958 | Jefferson | 362/100 |
| 3,162,374 | 12/1964 | Skokut | 362/100 |
| 4,293,894 | 10/1981 | Blank | 362/100 |
| 4,360,803 | 11/1982 | Heiland | 340/542 |
| 4,475,067 | 10/1984 | Rowe | 362/100 X |
| 4,760,380 | 7/1988 | Quenneville et al. | 340/542 |

*Primary Examiner*—Eugene R. LaRoche
*Assistant Examiner*—Do Hyun Yoo
*Attorney, Agent, or Firm*—John E. Reilly

[57] ABSTRACT

An illuminating circuit for the key slot in a locking device is made up of a high intensity light source which is mounted on the face plate of the lock in close proximity to the key slot, a piezoelectric crystal is mounted within or adjacent to the lock to respond to vibrations created, for example, by tapping on the face plate to generate an electrical signal, and a control circuit including a timer and battery respond to the electrical signal generated by the crystal to energize a light source for a predetermined time interval after receiving the electrical signal from the crystal.

10 Claims, 1 Drawing Sheet

TOUCH-SENSITIVE ILLUMINABLE DOOR LOCK

This invention relates to door locks provided with means to illuminate the front face of the lock; and more particularly relates to a novel and improved touch-sensitive, illuminable door lock assembly in which the key slot is illuminated for a predetermined time interval to facilitate insertion of a key into the lock.

BACKGROUND AND FIELD OF INVENTION

Entry doors customarily include one or more door locks, such as, a doorknob lock or deadbolt. Each lock extends through an opening in the door and typically includes a stem with a mechanism including a key slot at the outer end of the stem. When a key is inserted into the slot and rotated, it will cause the stem to rotate about its longitudinal axis to release a door latch from a normally locked position extending into the door jamb.

Various means have been devised in the past to illuminate a doorway, such as, light fixtures placed over the door. Although these are effective to some extent in illuminating the door lock itself so as to avoid hunting for the slot or properly inserting the key into the slot, a more efficient means of lighting is desirable. It has also been proposed in the past to incorporate a lighting device directly into the doorknob or locking device so as to be situated in close proximity to the key slot and to better illuminate the slot to facilitate locking or unlocking of the door. Among other drawbacks in illuminating devices of the type that have been utilized in the past is that they have to be left on all the time and use up excess energy, often require substantial redesign and increase in size of the lock itself, or require a separate switch or electrical connection to activate the light source each time.

SUMMARY OF INVENTION

It is therefore an object of the present invention to provide for a novel and improved illuminated door lock assembly.

It is another object of the present invention to provide for a novel and improved illuminable door lock assembly which will fully illuminate the face of the lock containing the key slot, can be activated without a separate switch or electrical connection and is otherwise highly efficient and simple to manufacture and use.

It is a still further object of the present invention to provide for a novel and improved illuminated door lock unit which can be incorporated into existing doorknobs with little, if any, modification required to the knob or locking mechanism, occupies a minimum of space and yet is highly effective in use; and further wherein a lighting circuit is provided which is motion or impact-sensitive to energize a light source over a predetermined time interval necessary to lock or unlock the door.

In accordance with the present invention, an illuminable lock assembly has been devised and which is specifically adaptable for use in a doorknob lock for an entry door in which a locking mechanism extends through an opening in the door having a face plate on an exterior surface of the door and a key slot for insertion of a key to actuate the locking mechanism, the improvement residing in a high intensity light source on or associated with the face plate, a portable power source, motion-sensing means responsive to motion or vibration to generate an electrical signal, and circuit means responsive to the electrical signal generated to electrically interconnect a portable power source and the light source. Preferably, the light source is of a type, such as, an LED which can be energized by a relatively low voltage source and illuminate a fairly broad area, and the circuit means preferably includes a timer circuit to regulate the time interval over which the light source is energized each time that the motion-sensing means is activated.

A preferred moton-sensing means is a piezoelectric crystal in the form of a thin transducer strip which occupies a minimum of space and can be incorporated into the lock assembly along with the circuit means and portable power source. The crystal will respond to extremely low level motion or vibration to activate the circuit.

The above and other objects, advantages and features of the present invention will become more readily appreciated and understood from a consideration of the following detailed description of a preferred embodiment of this invention when taken together with the accompanying drawings, in which:

DETAILED DESCRIPTION OF THE PREFERRED EMBODIMENT

Figure 1:
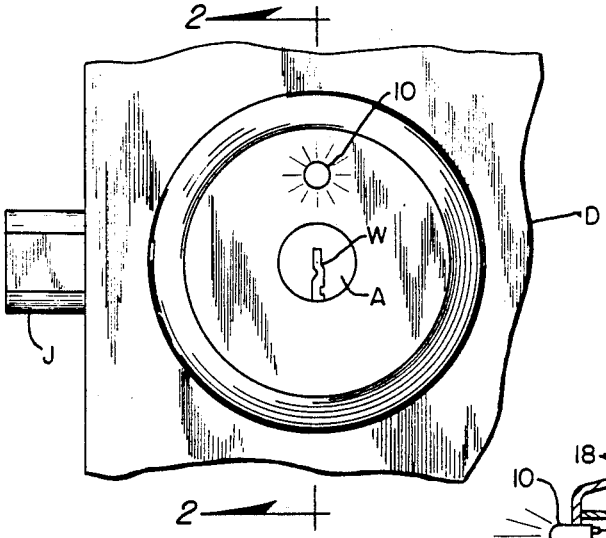
FIG. 1 is a fragmentary view of a door lock assembly and illustrating a light source of the preferred form of invention disposed on a doorknob of the lock assembly.
Figure 2:
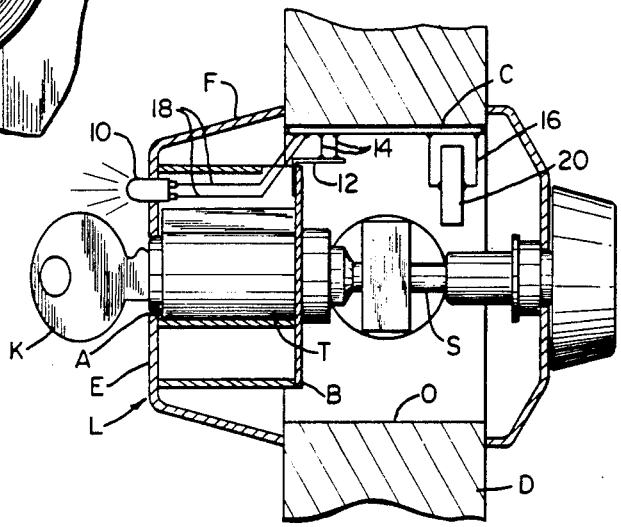
FIG. 2 is a cross-sectional view taken about lines 2—2 of FIG. 1.
Figure 3:
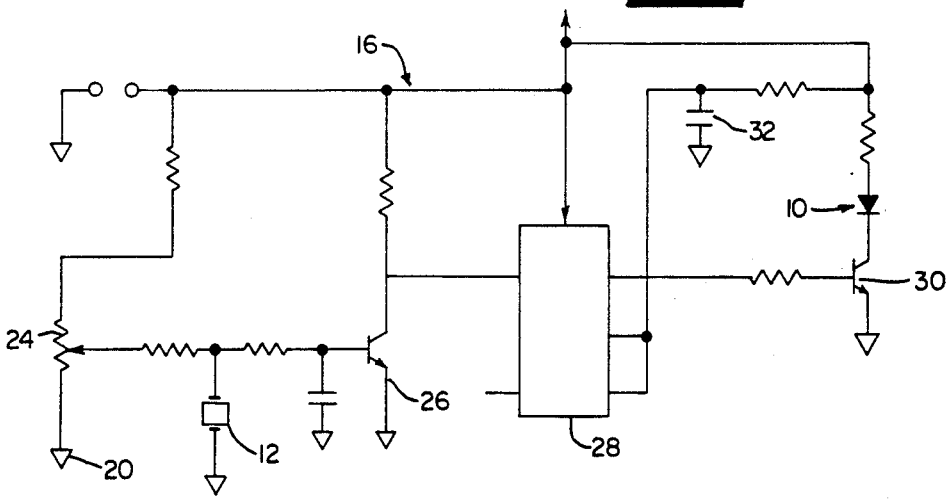
FIG. 3 is a circuit diagram of a preferred form of control circuit for activating the light source in accordance with the present invention.

Referring in detail to the drawings, there is shown by way of illustrative example in FIGS. 1 and 2 the installation of a preferred form of lock illuminating circuit including light source 10 in a conventional door lock assembly broadly designated at L. As a setting for the present invention, the door lock assembly L is a standard deadbolt which extends through the opening O in an entry door D and includes an elongated stem S, tumbler mechanism T with key slot W on the external side of the door. The key slot is intended to receive a key K which through the tumbler mechanism T will rotate the stem and actuate a latch J for extension into a door jamb, not shown, in a conventional manner. The locking mechanism as described and particularly the tumbler portion T is housed within a generally cup-shaped face plate F which terminates in a flat end surface E and is provided with an aperture A to receive the key slot W of the tumbler T.

In accordance with the present invention, the light source 10 is mounted in an annular space formed within the face plate F and projects outwardly through an opening in the end surface E directly above the key slot W. A thin piezoelectric film or crystal 12 defines a motion-sensing element for activating the light source in a manner to be described. The crystal 12 is preferably affixed to a solid portion of the lock L, such as, a base plate B for the tumbler T and which is spaced concentrically within the opening O in the door. Electrical leads 14 extend from the crystal 12 into a circuit board 16 for controlling the light source. The circuit board 16 can be mounted in any convenient space within the locking device, such as, to a cylindrical sleeve C which is inserted within the opening O of the door and forms part of the lock assembly L. Electrical leads 18 also extend from the light source 10 into the circuit board 16. In addition, a power source, such as, a battery 20 defines a portable power source for the light source 10 suitably located adjacent to the circuit board 16 in the door lock assembly L.

In the preferred form of control circuit, the piezoelectric crystal 12 will, when vibrated, change capacitance so as to produce a small voltage which is summed with the bias voltage produced by a resistor divider network 24 to drive a Darlington transistor 26. The sensitivity of the motion sensor 12 can be adjusted by the network 24 to provide the desired sensitivity to any motion or vibration. The collector of the transistor 26 is connected to a timer circuit 28 and triggers the timer circuit causing the LED 10 to light. The timer circuit 28 itself is used to control the length of time that the light source 10 will remain lighted before resetting itself, and the output of the timer is directed into the base of a transistor 30 so as to bias the transistor 30 to enable the light source 10. An RC network 32 includes a high impedance resistor for optimum biasing in the output circuit. Conventional resistors and RC networks are provided in the circuitry as illustrated, and the circuitry is principally designed to produce a high intensity light output which can be energized for the desired time interval, such as, on the order of 10 to 20 seconds to fully illuminate the key slot. Further, as described, the timer circuit can be reset to decrease or increase the time of illumination and is automatically resettable each time that the face plate is tapped to continue to energize the light source for as long as needed.

An important feature of the present invention resides in the use of a high intensity light source and specifically an LED 10 as designated in the drawing which can be activated by the piezoelectric crystal generating an electrical signal in response to extremely low level motion or vibration sensed by the crystal. This motion or vibration can be created, for example, by a light tapping on the face plate E of the door lock L either with a key or finger; or slight jarring or knocking on the door can create the necessary vibration. Crystals of the type described and shown in the drawing can operate over a wide temperature range and, for example, be highly sensitive to vibrations even at temperatures as low as −40° F. For that reason, it is not extremely important that the crystal be located at a particular location in the door lock so long as the motion or vibration will be transmitted to the crystal and the crystal will be free to respond to such motion or vibration in generating the low level signal for the circuit. Further, it will be apparent that while the device has been described and shown as part of a deadbolt locking device, it is readily conformable for use with virtually any type of locking device which requires a key, such as, a doorknob locking unit. Moreover, the illuminating circuit as described including the portable power source and motion sensor can be used to illuminate one or more light sources. For example, a light source may be positioned in proximity to a key slot both on the interior and exterior of the entry way and energized by a single or common circuit.

It will be evident from the foregoing that various light sources may be employed in place of the light source 10 and may be mounted at different selected locations on or adjacent to the door lock. Thus, the entire circuit including the crystal and light source may be mounted in the door without disturbing the door lock itself. For this reason, the illuminating circuit including the light source need not be incorporated directly into the door lock and therefore can be used with existing door locks without any modification whatsoever.

Still further, it will be evident that the light source and circuitry as devised are conformable for use on combination locks in which numbered indicia on the face plate serve to actuate the locking mechanism instead of a key and key slot. Moreover, any part or all of the face plate or tumbler mechanism may be made of a translucent material, if desired, to enhance the illumination of the key slot or other locking device.

It is therefore to be understood that various other modifications and changes may be made in the construction and arrangement of parts comprising the preferred form of invention as described without departing from the spirit and scope of the invention as defined by the appended claims and reasonable equivalents thereof.

I claim:

1. In a door locking device for an entry way in which a locking mechanism extends through an opening in the entry way including a face plate on an exterior surface of said entry way and a key slot therein for insertion of a key to actuate said locking mechanism, the improvement comprising:

a light source mounted on said exterior surface adjacent to said key slot;

a power source;

motion-sensing means disposed internally of said entry way responsive to motion or vibration of said entry way to generate an electrical signal; and circuit means associated with said power source responsive to receiving said electrical signal from said motion-sensing means to energize said light source.

2. In a door locking device according to claim 1, said light source disposed in an opening in said face plate in close proximity to said key slot.

3. In a door locking device according to claim 1, said circuit means including a timer circuit for energizing said light source over a predetermined time interval after receiving said electrical signal.

4. In a door locking device according to claim 1, said motion-sensing means defined by a piezoelectric crystal mounted in proximity to said locking mechanism.

5. In a door locking device according to claim 1, said circuit means and said power source mounted internally of said locking mechanism.

6. An illuminating circuit for a lock assembly in an entry way in which a locking mechanism extends through an opening in the entry way including a face plate on an exterior surface of said entry way and actuating means on said face plate to actuate said locking mechanism, said circuit comprising:

a light source on said face plate;

a portable power source;

motion-sensing means disposed internally of said entry way and responsive to vibration of said entry way sensed to generate an electrical signal; and circuit control means associated with said power source and being responsive to said electrical signal generated by said motion-sensing means to energize said light source.

7. An illuminating circuit according to claim 6, said circuit control means including a timer circuit for energizing said light source for a predetermined time interval after receiving said electrical signal, and said motion-sensing means defined by a piezoelectric crystal mounted in said lock assembly.

8. An illuminating circuit according to claim 7, said light source being a LED disposed in an opening in said face plate in close proximity to said actuating means.

9. An illuminating circuit according to claim 6, said circuit control means and said portable power source mounted internally of said lock assembly.

10. In a door lock assembly for an entry door in which a locking mechanism extends through an opening in said door and includes a face plate on an exterior surface of said door with a key slot for insertion of a key to actuate said locking mechanism, the improvement comprising:

a high intensity light source mounted on said face plate in close proximity to said key slot;

a portable power source;

circuit control means mounted in said door lock assembly including a timer circuit associated with said power source and being directly responsive to an electrical signal to energize said light source; and motion-sensing means including a piezoelectric crystal mounted in said door lock assembly responsive to vibrations sensed in said door lock assembly to generate said electrical signal and transmit same to said circuit control means.

* * * * *